United States Patent [19]

Pilch et al.

[11] Patent Number: 4,742,982

[45] Date of Patent: May 10, 1988

[54] HANGER FOR CHEMICAL DISPENSER

[75] Inventors: Stanley Pilch, Hicksville; Elliott Subervi, Baldwin, both of N.Y.

[73] Assignee: Kiwi Brands, Inc., Douglassville, Pa.

[21] Appl. No.: 455,973

[22] Filed: Jan. 6, 1983

[51] Int. Cl.[4] ..... F04G 5/06; E03D 9/02

[52] U.S. Cl. ..... 248/231.8; 248/215; 248/320; 24/331; 24/543

[58] Field of Search ..... 4/227, 228, 231, 225, 4/226; 248/215, 221.3, 221.4, 297.3, 304, 308, 309 R, 311.3, 226.5, 213.4, 311.2, 231.8, 320; 24/235, 239, 331, 543, 370

[56] References Cited

U.S. PATENT DOCUMENTS

| | | | |
|---|---|---|---|
| 2,260,584 | 10/1941 | Schuck et al. | 24/370 |
| 3,241,718 | 3/1966 | Kemper | 4/228 X |
| 3,908,209 | 9/1975 | Fillmore | 4/228 X |
| 3,983,603 | 10/1976 | Joyce | 24/16 PB |
| 4,247,070 | 1/1981 | Dirksing | 4/228 X |

*Primary Examiner*—Charles E. Phillips

*Attorney, Agent, or Firm*—Amster, Rothstein & Ebenstein

[57] ABSTRACT

An improved hanger for a toilet tank dispenser which comprises a relatively straight inner leg member, a generally hook-shaped outer leg member, and an angled connector joining said inner and outer leg members. The clamping force generated by the foregoing arrangement causes the inner leg and the dispenser attached thereto to be biased against the inner toilet tank wall.

7 Claims, 2 Drawing Sheets

HANGER FOR CHEMICAL DISPENSER

The present invention relates to hangers for supporting chemical dispensers such as toilet tank dispensers. More particularly, the present invention relates to an improvement in a hanger which supports a toilet tank dispenser from the top edge of the toilet tank wall and which incorporates a feature to hold the dispenser in an essentially vertical position against an inside vertical wall of the toilet tank.

Hangers which support dispensers inside a toilet tank are well known in the art and prior art patents relating to such hangers are extensively discussed in Dirksing U.S. Pat. No. 4,247,070. In general, the prior art, including, for example, U.S. Pat. Nos. 3,675,254; 3,538,520 and 3,178,070 describe hook-shaped or U-shaped clips which merely serve to clip the dispenser to the top edge of the toilet tank wall without regard to either the slope of the toilet tank wall or the final location of the dispenser to which the hanger is depended. The Dirksing '070 patent describes an improvement over prior art hangers for toilet tank dispensers which is designed to compensate for any tilt in the toilet tank wall and to hold the dispenser in an essentially vertical position. Dirksing provides a generally U-shaped clip which includes a resilient tab means extending inwardly from the inner leg of the clip which contacts the toilet tank wall in such a manner as to co-act with a pivot point located on the outer leg of the clip and produce a coupled force system which holds the dispenser in a vertical position against the inner toilet tank wall.

It is an object of the present invention to provide an improved hanger which eliminates a significant structual element of the hanger, i.e., the resilient tab means, described in the Dirksing '070 patent, while still serving to hold the dispenser in the desired vertical position.

The present invention provides a hanger for a toilet tank dispenser which comprises an inner leg member including means for receiving a dispenser to be attached thereto; an outer leg member adapted to contact an outer surface of the tank wall; and an angled connector member joining said inner and outer leg members. The geometric relationship between the inner and outer leg members and the angled connector member is such that when the outer leg member engages the outer surface of the tank, a clamping force is produced and the lower portion of the inner leg member and the dispenser attached thereto will be pressed or biased against the inner tank wall; The biasing action is sufficient to resist any tendency which the dispenser might otherwise have to swing away from the wall or otherwise move, as a result of the forces generated, for example, by rising water in the tank. The inner leg is also provided with suitable stop means which, together with a complementary sheath section forming part of the dispenser permits the dispenser location within the tank to be adjustable within broad limits, thereby making it possible to utilize dispensers which operate at a relatively critical location with respect to the water line of the tank as well as dispensers which lack such a critical positioning factor.

The invention will be further understood from the following more detailed description taken in connection with the accompanying drawings wherein FIG. 1 is a perspective view of a preferred hanger of the present invention showing the hanger fully extended with respect to the dispenser;

Figure 3:
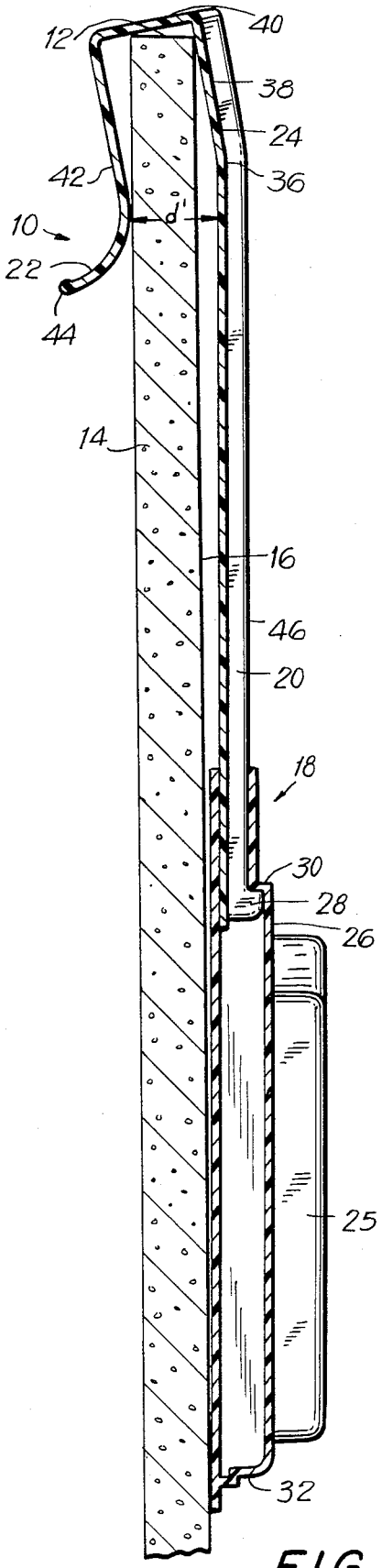
FIG. 3 is a cross-sectional view of the hanger of FIG. 1, taken along section line 3—3 in FIG. 1.

Referring to the drawings, there is shown an embodiment 10 of the hanger of the invention which, in FIG. 3 is placed over the top edge 12 of a tank wall 14 having an inner surface 16 which will normally be exposed to water when the tank is in normal operation. A dispenser 18, which may be of any of the numerous constructions known in the prior art, is attached to the inner leg 20 of hanger 10. One particularly preferred form of dispenser is described in copending, commonly assigned application Ser. No. 456,109 filed in the names of Roger Doggett et al., filed on even date herewith now in U.S. Pat. No. 4,453,278 , disclosure of said application being hereby incorporated herein by reference. The dispenser 18 generally comprises a pair of vacuum formed dispenser compartments 23 and 25 for separately dispensing defined amounts of detergent and disinfectant solutions into the tank water during each flush cycle; and a central vacuum formed sheath 26 of suitable crosssection to snugly but slidably hold inner leg 20.

Figure 1:
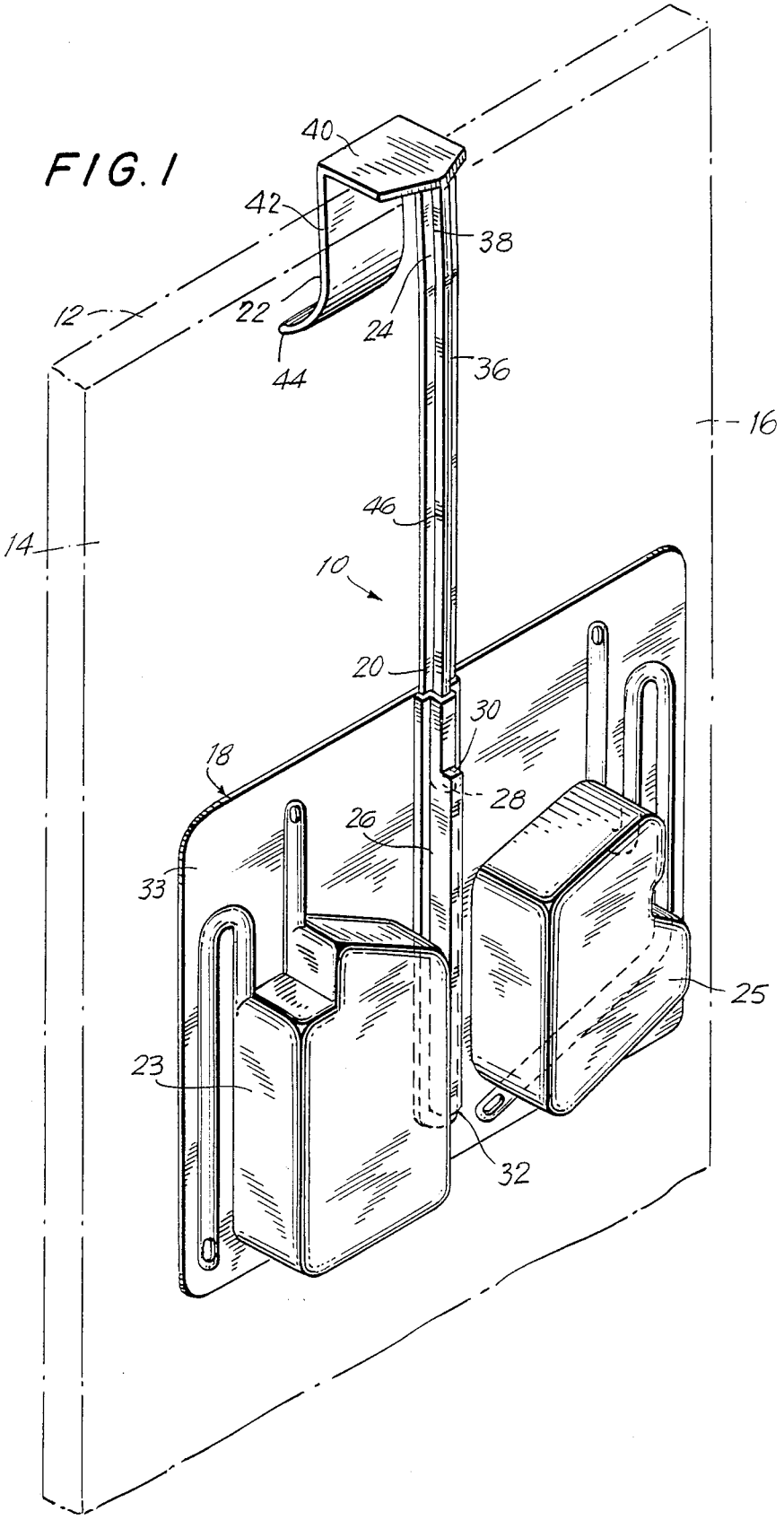
Figure 2:
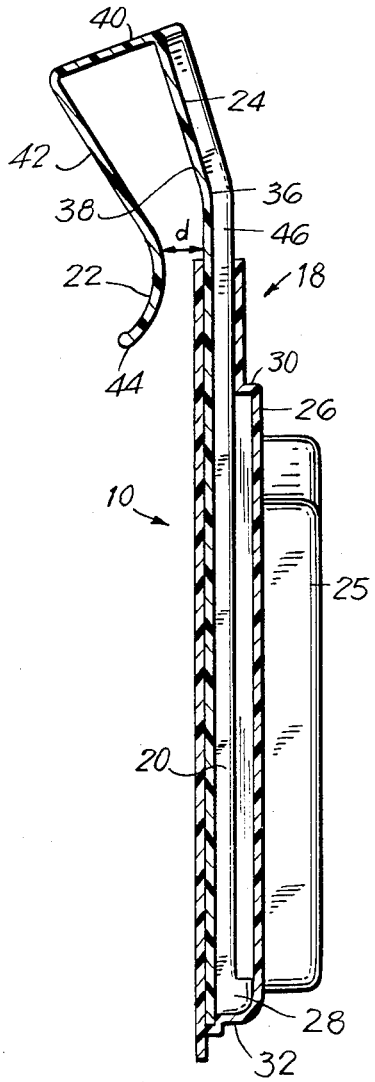
FIG. 2 is a cross-sectional view of the hanger of FIG. 1 showing the hanger in its unextended position.

As best seen in FIGS. 2 and 3, the dispenser 18 may be adjustably positioned with respect to inner hanger leg 20 from the unextended position shown in FIG. 2, which would normally be used for packaging and shipping purposes, to the fully extended position of FIG. 3. The extension limit is defined by stop means 28 located on the end of inner leg 20, which comprises a section of increased cross-section as compared to the main portion of inner leg 20, and a shoulder 30 formed in sheath 26 which defines an area of reduced cross-section in the sheath 26. The foregoing arrangement permits the hanger to be extended by an amount which is almost equal to the full length of inner leg 20 and, more specifically, to the point where stop means 28 abuts shoulder 30, as seen in FIG. 3.

Adjustment of the hanger at any position intermediate the unextended position where stop means 28 abuts the closed bottom 32 of sheath 26 and the extended position where stop means 28 abuts shoulder 30 can be achieved because the width of inner leg 20 is about the same as the width of sheath 26, thereby creating a snug fit which permits the development of sufficient friction forces to overcome any tendency of the dispenser 18 to move downward as a result of its own weight, or upward as a result of any lifting forces generated by the rising water in the tank. Ordinarily, the separately preformed hanger 10 will be placed in vacuum-formed member 33, in which sheath and dispenser compartments have been formed, and assembly of the dispenser 18 is thereafter completed by lamination of a back member 34 thereto.

Turning more specifically to the hanger, as best seen in FIG. 2, hanger 10 comprises an inner leg 20, an outer leg 22, and an angled connector member 24. Inner leg 20 extends from stop means 28 to joint 36 which defines the beginning of integral angled connector member 24. Angled connector member 24 comprises first angled connector section 38 which is disposed within the tank and is contiguous to the upper portion of inner leg 22. Section 38 extends inwardly from joint 26 toward the inner tank wall and terminates just beyond the upper edge 12 of the tank wall, where it is joined to second angled connector section 40. Section 40 extends outwardly and terminates beyond the outer periphery of the tank wall.

As shown, angled connector sections 38 and 40 are at approximately right angles to each other. However, the precise nature of this junction is not critical, provided that the angled connector member contacts the upper region of the tank wall at one or more points, and it could comprise a rounded corner or a larger or smaller angle without departing from the scope of the invention. Outer leg 22 comprises an upper portion 42 which joins angled connector section 40 at approximately right angles and extends downwardly therefrom, eventually making contact with the outer surface of the tank wall. The angle of the junction between section 40 and outer leg 22 is also not critical and can also be rounded or be a larger or smaller angle without departing from the spirit of the invention. The shape of the lower portion 44 of outer leg 22 is also not critical and can be angular rather than rounded or hook-shaped as shown.

As best seen by comparing FIGS. 2 and 3, the distance between the innermost portion of outer leg 22 and inner leg 20 is increased from its normal relaxed spacing d (as shown in FIG. 2) to the stressed condition d' of FIG. 3 when the hanger is in place around the top edge of the toilet tank 12. The combination of the force produced on the outer tank wall by the outer leg 22 and the contact between the leading edge of the toilet tank and the angled connector member 24 produces a clockwise rotation or clamping action and the lower portion of inner leg 20 is biased against the inner tank wall 16. This serves to hold the dispenser 18 attached to inner leg 22 in a generally vertical position and to resist any pendulum motion caused, for example, by the rising tank water which might otherwise cause the dispenser to swing away from the inner tank wall surface 16.

The hanger of this invention is preferably formed from flexible plastics such as ABS, high impact styrene, polyolefins, and, preferably, polypropylene, although it is possible to use flexible metals or other more expensive materials. Moreover, as illustrated, the hanger sections have a T-shaped cross section 46 to improve stiffness characteristics, except that a flat cross section is used for outer leg 22 and angle connector section 40 in order to minimize any interference between those members and the tank cover or surrounding walls. The method of forming the hanger is not critical and any form of molding can be employed.

It is understood that the forms of the invention illustrated herein are preferred embodiments and that various modifications can be made without departing from the spirit of the invention.

What is claimed is:

1. A hanger for a toilet tank dispenser consisting essentially of an inner leg member to which a toilet tank dispenser is secured, an angled connector member contiguous to the upper end of said inner leg member, said angled connector member comprising a first section integral with said inner leg member which extends at an angle towards the inner surface of the toilet tank wall and terminates above the upper edge of the toilet tank wall and a second section which extends outwardly from said first section such that at least a portion thereof makes contact with the top surface of said upper edge of the toilet tank wall, and an outer leg member integral with said second section of said angled connector member which extends downwardly therefrom at an angle such that at least a portion of said outer leg member contacts the outer wall of said toilet tank, said inner leg member, said angled connector member, and said outer leg member together creating a clamping force around said toilet tank wall which causes the lower portion of said inner leg member and the dispenser attached thereto to be biased against the inner tank wall.

2. The hanger of claim 1 wherein said members are formed of a resilient material.

3. The hanger of claim 1 wherein the lower portion of said outer leg member is a generally hook-shaped member and said outer leg member contacts the outer wall of said tank in the vicinity of the rounded portion of said hook.

4. The hanger of claim 1 wherein the geometric relationship between said inner and outer leg members is such that the shortest distance between said outer leg member and said inner leg member is increased when said hanger is positioned over the upper edge of said toilet tank.

5. The hanger of claim 1 wherein the cross-sectional shape of said inner leg member is selected so as to frictionally engage a sheath in said dispenser.

6. The hanger of claim 5 further including stop means on the lower portion of said inner leg member for holding said inner leg member in said sheath.

7. The hanger of claim 6 wherein said stop means comprises an area of enlarged cross-section at the lower end of said inner leg member.

* * * * *